US006952187B2

(12) United States Patent
Annamaa et al.

(10) Patent No.: US 6,952,187 B2
(45) Date of Patent: Oct. 4, 2005

(54) ANTENNA FOR FOLDABLE RADIO DEVICE

(75) Inventors: Petteri Annamaa, Oulunsalo (FI); Jyrki Mikkola, Kaustinen (FI); Petra Ollitervo, London (GB)

(73) Assignee: Filtronic LK Oy, Kempele (FI)

( * ) Notice: Subject to any disclaimer, the term of this patent is extended or adjusted under 35 U.S.C. 154(b) by 0 days.

(21) Appl. No.: 10/731,196

(22) Filed: Dec. 8, 2003

(65) Prior Publication Data

US 2004/0125042 A1 Jul. 1, 2004

(30) Foreign Application Priority Data

Dec. 31, 2002 (FI) ..... 20022295

(51) Int. Cl.[7] ..... H01Q 1/24
(52) U.S. Cl. ..... 343/702; 343/700 MS; 343/895
(58) Field of Search ..... 343/700 MS, 702, 343/845, 895

(56) References Cited

U.S. PATENT DOCUMENTS 5,936,587 A * 8/1999 Gudilev et al. ..... 343/752
6,031,495 A * 2/2000 Simmons et al. ..... 343/702
6,239,765 B1 5/2001 Johnson et al.
6,307,511 B1 10/2001 Ying et al.
2002/0068603 A1 6/2002 Ito et al.

FOREIGN PATENT DOCUMENTS

EP 0 508 567 B1 9/1997
EP 0 814 536 A2 12/1997
EP 1 306 922 A2 5/2003
WO WO-02/19465 A1 3/2002

* cited by examiner

*Primary Examiner*—Shih-Chao Chen
(74) *Attorney, Agent, or Firm*—Darby & Darby

(57) ABSTRACT

A small and foldable radio device antenna and a radio device which has an antenna according to an embodiment of the invention. The radiating element in the antenna is a conductor having an outline shaped substantially like a rectangle and defining a plane which is perpendicular to the ground plane situated on the circuit board of the radio device. The radiating element fits inside the foldable device in the perpendicular position. The element is connected to the radio device only by its feed point. Resonating frequencies of the element can be arranged by shaping the element, and by means of discrete components. The matching of the antenna is arranged by providing an appropriate distance between the radiating element and ground plane. In an operating situation, an antenna gain is achieved which is considerably higher than that of a PIFA of equal height.

12 Claims, 3 Drawing Sheets

ANTENNA FOR FOLDABLE RADIO DEVICE

The invention relates to an antenna intended to be used in a small and foldable radio device. The invention also relates to a radio device which has an antenna according to the invention.

BACKGROUND OF THE INVENTION

Commercial portable radio devices, such as mobile phones, include some foldable, i.e. clamshell models. These have got two parts such that the parts can be folded over, on a hinge, so that they lie on top of each other or adjacently end-to-end in almost the same plane. In the first, closed-up, position, the device is particularly small, and in the latter, opened, position the device is used during communication.

Antennas used in foldable mobile phones are normally monopole-type external antennas. Their drawback is the impracticality generally associated with a protruding structural element. Naturally it would be possible to use internal PIFA-type planar antennas, but the thin structure of the folding parts in the mobile phone would result in the distance between the radiating plane and ground plane to be so small that the antenna gain would be unsatisfactory. Furthermore, it would be possible to have an internal monopole-type planar antenna such that the radiating plane would not be located face to face with the ground plane. In that case the thinness of the device would cause no problem as such, but the electrical characteristics such as matching and antenna gain would again be unsatisfactory. Matching could be improved using an additional circuit, but this would require the use of several discrete components.

SUMMARY OF THE INVENTION

It is an object of the invention to reduce the aforementioned drawbacks associated with the prior art. An antenna according to the invention is characterized in that which is specified in the independent claim 1. A radio device according to the invention is characterized in that which is specified in the independent claim 10. Some preferred embodiments of the invention are specified in the other claims.

The idea of the invention is basically as follows: The radiating element in an antenna is a conductor having an outline shaped substantially like a rectangle and defining a plane which is perpendicular to the ground plane situated on the circuit board of the radio device. The radiating element is so narrow that it fits inside one of the folding parts of a typical foldable device in said perpendicular position. The element is coupled to the radio device only by its feed point. Resonating frequencies of the element can be arranged in desired locations besides by shaping the element, also by means of discrete components.

An advantage of the invention is that an antenna with satisfactory electrical characteristics fits inside a foldable radio device. The antenna gain during use of the device is considerably higher than that of a PIFA of the same height, for instance. Another advantage of the invention is that antenna matching is easily arranged by providing an appropriate distance between the radiating element and ground plane. A further advantage of the invention is that an antenna according to the invention is very compact and saves space. A further advantage of the invention is that an antenna according to the invention results in a lower SAR (specific absorption rate) value at the user's head than prior-art antennas.

BRIEF DESCRIPTION OF THE DRAWINGS

The invention will now be described in detail. Reference is made in the description to the accompanying drawings in which.

DETAILED DESCRIPTION OF THE INVENTION

Figure 1:
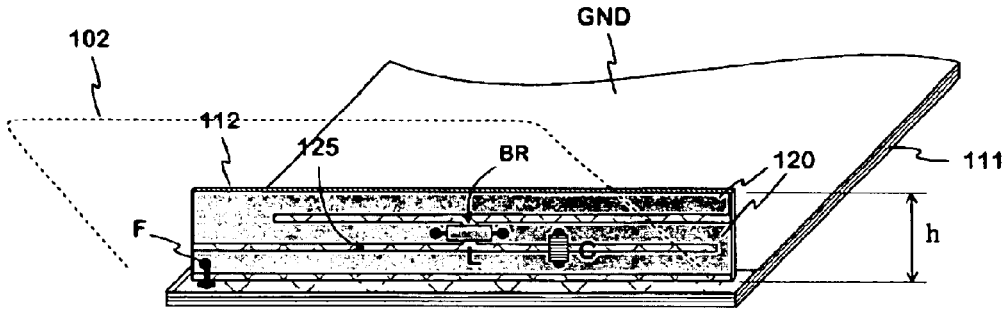
FIG. 1 shows a first example of an antenna according to the invention.

FIG. 1 shows an example of an antenna according to the invention. The figure shows a circuit board 111 in a foldable radio device, the upper surface of which circuit board mainly being a conductive ground plane GND. The circuit board is included in a first part of the foldable radio device. The figure also shows in broken line a second part 102 of the foldable radio device in the opened position. At one end of the circuit board of the radio device is an oblong antenna circuit board 112. The antenna circuit board is supported on the the radio device circuit board with a long side against the latter so that said circuit boards are in right angles with respect to each other. The radiating element in the antenna is a conductive strip 120 on the antenna circuit board. The plane of the radiating element is thus perpendicular to the ground plane, which is essential in the invention. The conductive strip 120 is situated on the outer surface of the antenna circuit board, i.e. on that surface which is located on the side of an end of the radio device circuit board 111. The feed point F of the radiating element is located in a lower corner of the antenna circuit board 112. From there on the conductive strip 120 travels along the lower edge of the antenna circuit board to one end thereof, then at the middle of the antenna circuit board back to the end on the side of the feed point F and further along the upper edge of the antenna circuit board back to the other end thereof. The radiating element thus makes a meandering pattern which in this case resembles an S which is very wide and low. The lowness comes from the fact that the width of the antenna circuit board, i.e. the height h of the antenna is relatively small.

In the example of FIG. 1 there is a break BR in the middle portion of the conductive strip 120 so that the conductive strip in fact has two parts. Functionally, however, the strip is continuous because a discrete coil L is connected across the break which coil has a very small resistance. The example structure additionally comprises another discrete component, a capacitor C which is connected across the slot 125 between the lowest and middle portion of the conductive strip 120 further away from the end on the side of the feed point F than from the opposing end. The fundamental resonating frequency of the conductive strip and the nearest harmonic can be tuned to desired locations by choosing a suitable inductance for the coil L and capacitance for the capacitor C as well as suitable locations for these components, and of course by choosing suitable dimensions for the conductive strip itself. The locations of the discrete components shown in FIG. 1 are advantageous. A good result can also be achieved by cutting off the conductive strip between the middle and upper portion and placing the coil there. Two operation bands are provided for the antenna so that the fundamental resonating frequency falls into a frequency band of a radio system and the nearest harmonic frequency of the fundamental resonating frequency falls into a frequency band of another radio system. The upper operation band can be widened, if necessary, by choosing the dimensions of the slot 125 between the portions of the conductive strip so that a an oscillation is excited in the slot the frequency of which differing somewhat from said harmonic resonating frequency.

In all monopole-type structures, the like of which also the structure depicted in FIG. 1 is, the electrical characteristics of the antenna depend strongly on the location, shape and size of the ground plane. Above it was disclosed that in an antenna according to the invention the radiating element and the ground plane are perpendicular to each other. In addition, antenna matching can be arranged by means of the distance between the radiating element and the ground plane. In FIG. 1, the lowest portion of the conductive strip 120 is nearest the ground plane. An advantageous distance is obtained by means of a non-conductive strip at the lower edge of the antenna circuit board and by limiting the ground plane to a certain distance away from the antenna circuit board. A short-circuit conductor found in IFA (inverted F antenna) structures is of no use in antennas according to this invention.

Figure 2:
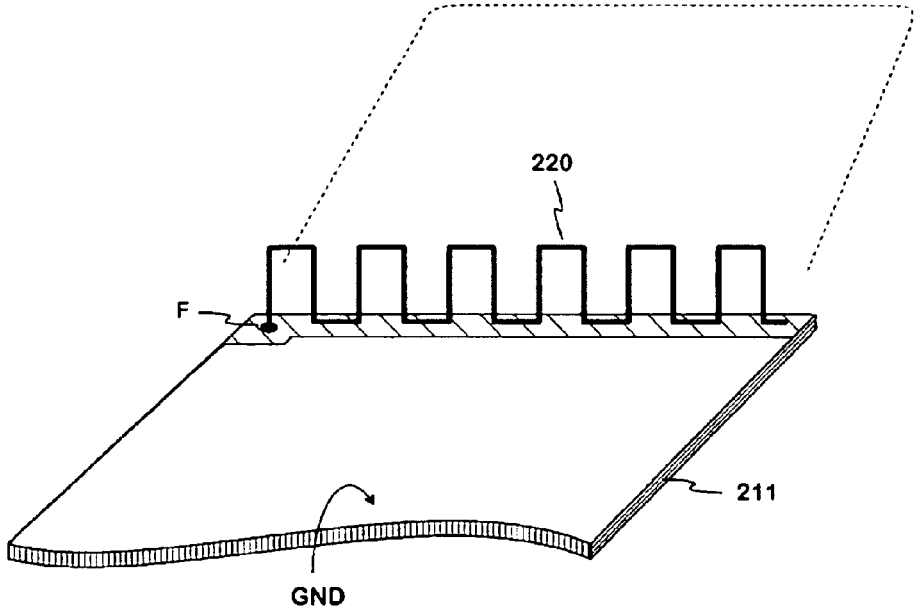
FIG. 2 shows a second example of an antenna according to the invention.

Words "upper" and "lower" as well as "vertical" and "horizontal" refer in this description and in the claims to the position of the device as depicted in FIGS. 1 and 2 and have nothing to do with the operating position of the device.

FIG. 2 shows a second example of an antenna according to the invention. The figure shows a horizontal circuit board 211 of a radio device the upper surface of which mainly being a conductive ground plane GND. Like in FIG. 1, a radiating element 220 of the antenna is located at one end of the circuit board of the radio device such that the plane defined thereby is perpendicular to the ground plane. The radiating element is now a rigid conductive wire which does not need an antenna circuit board to support it. The conductive wire 220 forms a meandering pattern which in this case is such that the vertical portions are equal in height to the whole element and the horizontal portions are relatively short in comparison with the length of the whole element. The feed point F of the radiating element is at one end thereof and the element has no short-circuit point. Every second horizontal portion of the radiating element, i.e. conductive wire 220, rests against the circuit board 211 at a distance from the ground plane GND which distance is suitable for the matching purpose. The radiating element can be tuned by means of discrete components in the same kind of manner as in FIG. 1.

Figure 3:
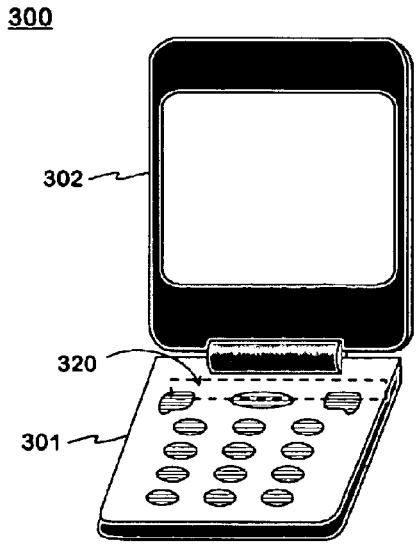
FIG. 3 shows an example of a radio device employing an antenna according to the invention.

FIG. 3 shows an example of a radio device according to the invention. The radio device 300 is a foldable mobile phone comprising, on a hinge, a first part 301 and a second part 302. These are considerably flatter than a conventional mobile phone having a single continuous cover. In FIG. 3 the phone is opened, i.e. the first part and the second part are turned at almost straight angle with respect to each other. A radiating element 320 of an antenna, like the one depicted above, is within the first part 301 close to the hinge of the device. In this example the first part 301 also includes a keypad, among other things, and the second part 302 a display, among other things. The first part advantageously also comprises the radio-frequency parts of the device, so that there is no need for an intermediate cable across the folding joint. Naturally the antenna may also be located in that part which contains the display.

Figure 4:
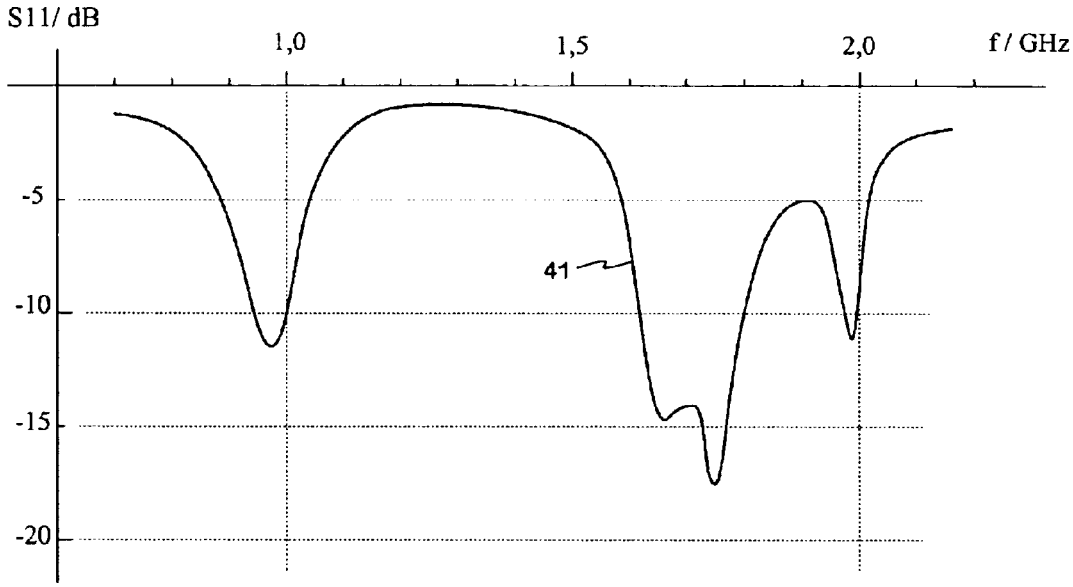
FIG. 4 shows an example of frequency characteristics of an antenna according to the invention.

FIG. 4 shows an example of the frequency characteristics of an antenna according to the invention. The example relates to the antenna depicted in FIG. 1 in an opened test structure equivalent to a mobile phone. The height h of the antenna is 6.4 mm, and the length 39 mm. Curve 41 shows the variation in the return attenuation of the antenna as a function of frequency. It shows that of the two operation bands of the antenna the lower one amply covers the frequency band 890–960 MHz of the GSM900 system (global system of mobile communications). There is a good margin for the downward shift of the operation band, caused by the turning of the folding parts of the phone on top of one another. The upper operating band is very wide because of utilization of a slot radiator, among other things. If a criterion for the operation band cut-off frequency is a return attenuation value of 5 dB, the upper operation band well covers both the frequency band 1710–1880 MHz of the GSM1800 system and the frequency band 1850–1990 MHz of the GSM1900 system.

Figure 5:
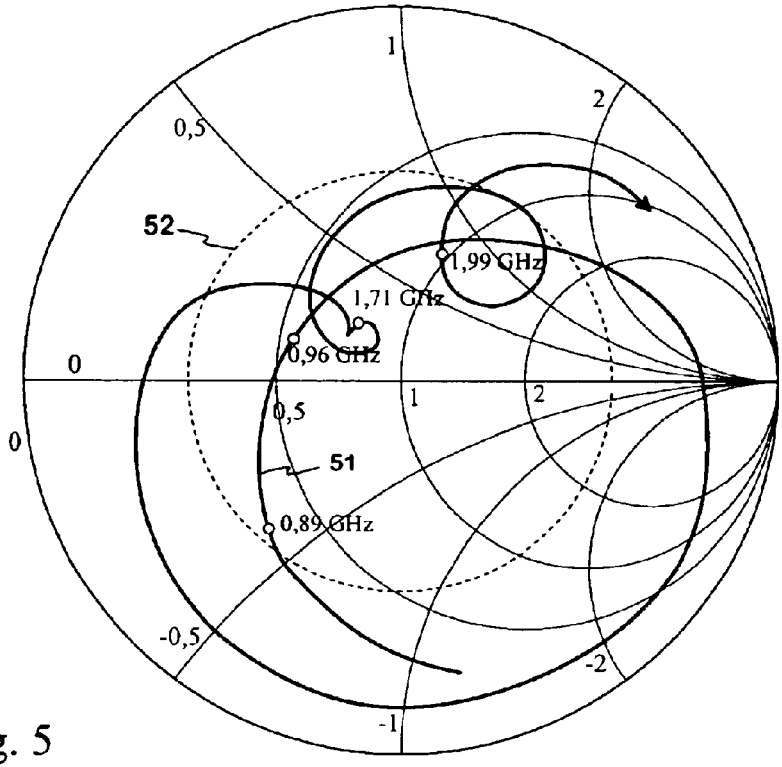
FIG. 5 shows an example of the matching of an antenna according to the invention.

FIG. 5 uses a Smith chart to illustrate the quality of the matching of the antenna for which the return attenuation curve 41 was drawn. Curve 51 depicts the variation in the complex reflection coefficient as a function of frequency. The closer to the center point of the outer circle a point in the curve, the better the matching at the frequency in question. The circle 52 drawn in broken line shows the limit within which the absolute value of the reflection coefficient is smaller than 0.56 i.e. below −5 dB. It is seen that the curve remains within this circle when the frequency varies within the ranges mentioned above.

Figure 6:
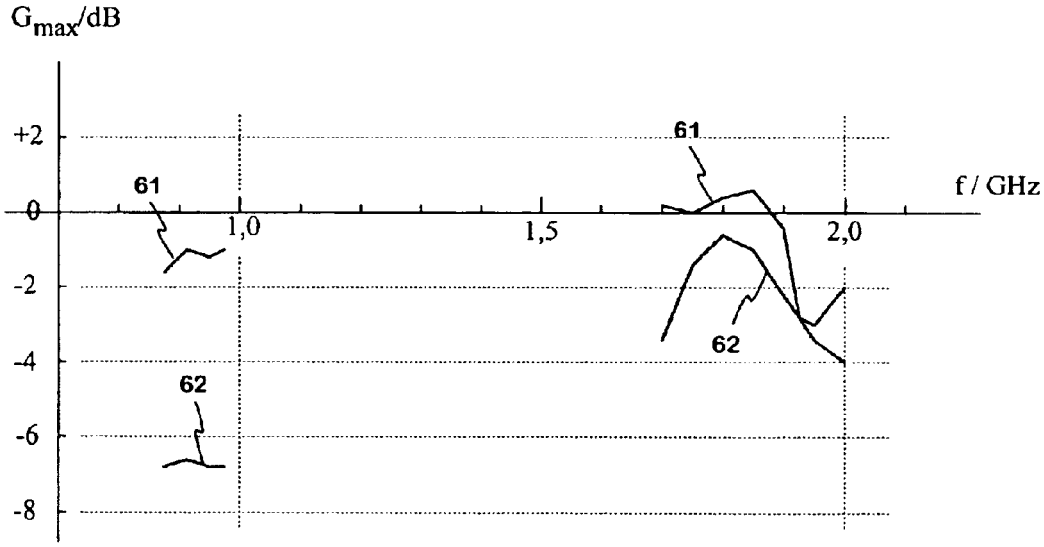
FIG. 6 shows an example of the antenna gain of an antenna according to the invention.

FIG. 6 shows an example of the antenna gain of an antenna according to the invention. Curve 61 represents the variation of antenna gain $G_{max}$ in the lower and upper operating bands, measured in the most advantageous direction. The measurement concerns an operating situation where the radio device is placed against the ear of the user. In the lower band the gain is about −1 dB and in the upper band it varies between −3 to +0.5 dB. For reference, FIG. 6 shows corresponding curves 62 for a prior-art dual-band PIFA (planar IFA) the height of which equals that of the antenna according to the invention. In the lower band the gain of the PIFA is nearly 6 dB smaller and in the upper band on average about 2 dB smaller than for the antenna according to the invention. Measured in free space, the difference between the antenna gains becomes smaller, in the upper band the PIFA is even better.

SAR value measurements on test structures show that in the lower operating band the antenna according to the invention produces values that are e.g. about 20% smaller than those of the PIFA. Also in the upper operating band, smaller values are achieved by means of a minor additional arrangement.

Some antenna structures according to the invention were described above. The invention does not limit the shapes and implementation techniques of the antenna elements to those described. The inventional idea can be applied in different ways within the scope defined by the independent claim 1.

What is claimed is:

1. A monopole antenna for a foldable radio device, the radio device comprising a ground plane, the antenna comprising:

a radiating element including a feed point, wherein an outline of the radiating element forms a planar figure which has a certain width and length, and a plane defined by said outline is substantially perpendicular to the ground plane of the radio device;

said width is smaller than an internal height of the radio device;

the radiating element coupled to the radio device only by the feed point; and the antenna has at least one resonant frequency and at least one operation band.

2. The antenna according to claim 1, wherein, to provide operation bands, the fundamental resonating frequency of the antenna is arranged to fall into a frequency band of a first radio system and the nearest harmonic of the fundamental resonating frequency is arranged to fall into a frequency band of a second radio system.

3. The antenna according to claim 1, the radiating element comprising at least one conductive strip on a surface of a circuit board.

4. The antenna according to claim 3, said conductive strip making a meandering pattern such that the horizontal portions thereof are substantially equal to the whole radiating element in length.

5. The antenna according to claim 3, wherein there are two of said conductive strips and they are connected in series through an inductive component to tune the resonating frequencies of the antenna.

6. The antenna according to claim 4, a capacitive component being connected between said horizontal portions to tune the resonating frequencies of the antenna.

7. The antenna according to claim 4, wherein at least one slot between said horizontal portions is arranged to radiate in an operation band of the antenna.

8. The antenna according to claim 1, the radiating element being a rigid conductive wire.

9. The antenna according to claim 8, said conductive wire making a meandering pattern such that the vertical portions thereof are substantially equal to the width of the whole radiating element.

10. The antenna according to claim 1, wherein in the direction of the normal of the radiating element an edge of the ground plane is limited to a certain distance from the radiating element to improve a matching of the antenna.

11. A foldable radio device comprising:

a first and a second folding part;

a monopole antenna, including a radiating element and a feed point, disposed within the first folding part;

the radiating element coupled to the radio device only by the feed point; and a ground plane;

an outline of the radiating element forms a planar figure having a certain width and length, and a plane defined by said outline is substantially perpendicular to the ground plane of the radio device.

12. The radio device according to claim 11, said first folding part comprising the radio-frequency parts of the radio device.

* * * * *